US009230749B2

(12) United States Patent
Cardwell et al.

(10) Patent No.: US 9,230,749 B2
(45) Date of Patent: Jan. 5, 2016

(54) AUTOTRIP PLUNGER WITHIN A REMOVABLE CIRCUIT BREAKER AND CIRCUIT BREAKER WITH AUTOTRIP PLUNGER

(71) Applicant: SIEMENS AKTIENGESELLSCHAFT, Munich (DE)

(72) Inventors: Justin Michael Cardwell, Dacula, GA (US); Celina Rea Palacios, Monterrey (MX)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 133 days.

(21) Appl. No.: 14/096,093

(22) Filed: Dec. 4, 2013

(65) Prior Publication Data

US 2014/0251775 A1 Sep. 11, 2014

(30) Foreign Application Priority Data

Mar. 6, 2013 (EP) ..... 13158003

(51) Int. Cl.

| | |
|---|---|
| ***H01H 5/00*** | (2006.01) |
| ***H01H 3/38*** | (2006.01) |
| ***H01H 71/12*** | (2006.01) |

(52) U.S. Cl.

CPC ..... *H01H 3/38* (2013.01); *H01H 71/126* (2013.01)

(58) Field of Classification Search

CPC ..... H01H 2083/205; H01H 2203/00; H01H 2205/002; H01H 71/126; H01H 9/20

USPC ..... 200/402, 50.21; 335/165; 218/154

See application file for complete search history.

(56) References Cited

U.S. PATENT DOCUMENTS

| | | | | |
|---|---|---|---|---|
| 4,829,278 | A * | 5/1989 | Livesey et al. | 337/50 |
| 4,950,848 | A * | 8/1990 | Maier et al. | 200/50.21 |
| 8,309,871 | B2 * | 11/2012 | Dupraz et al. | 200/400 |

FOREIGN PATENT DOCUMENTS

| | | | |
|---|---|---|---|
| DE | 3526336 | A1 | 1/1987 |
| EP | 1261007 | A1 | 11/2002 |
| EP | 2254137 | A1 | 11/2010 |

* cited by examiner

*Primary Examiner* — Vanessa Girardi

(74) *Attorney, Agent, or Firm* — Harness, Dickey & Pierce, P.L.C.

(57) ABSTRACT

An autotrip plunger of a circuit breaker is disclosed for opening contacts of the circuit breaker to install and uninstall the circuit breaker from a current source. In an embodiment, the autotrip plunger includes a compression spring, a first body section and a second body section, the first body section including a contact surface for contacting a tripping element of the circuit breaker and the second body section including an arbor shaft for fitting in the compression spring. At the free end of the arbor shaft, the arbor shaft includes at least one radial protrusion for holding the compression spring. A circuit breaker with such an autotrip plunger is also disclosed.

19 Claims, 4 Drawing Sheets

AUTOTRIP PLUNGER WITHIN A REMOVABLE CIRCUIT BREAKER AND CIRCUIT BREAKER WITH AUTOTRIP PLUNGER

PRIORITY STATEMENT

The present application hereby claims priority under 35 U.S.C. §119 to European patent application number EP 13158003.7 filed Mar. 6, 2013, the entire contents of which are hereby incorporated herein by reference.

FIELD

At least one embodiment of the invention generally relates to an autotrip plunger of a circuit breaker for opening contacts of the circuit breaker to install and uninstall the circuit breaker from a current source, comprising a compression spring. Further at least one embodiment of the invention generally relates to a circuit breaker, in particular to a molded case circuit breaker, comprising a fixed contact and a moveable contact, a tripping element for disconnect the moveable contact from the fixed contact and an moveable autotrip plunger for operating the tripping element to open the contacts of the circuit breaker to install and uninstall the circuit breaker from a current source.

BACKGROUND

A drawout is an electromechanical device to install and uninstall a molded case circuit breaker (MCCB) from a current source. For safety of the installer, a mechanical device called "autotrip plunger" must open the contacts of the MCCBs every time it is introduced or taken out from the current source. The autotrip plunger has a direct interaction with the MCCB mechanism via a tripping element, like a tripping lever, to open the contacts. The energy for doing this is provided by a compression spring called "autotrip plunger spring".

Nowadays, market requirements for molded case circuit breakers are set to preserve the performance requirements of a molded case circuit breaker and to withstand in less frame space. For achieving this, molded case circuit breakers mechanisms are designed to have big forces compromising the internal free space for other components in the molded case circuit breaker.

There are molded case circuit breakers with a plunger which has a slot in which an internal spring can be placed. The plunger is placed between the electronic trip unit (ETU) or the thermal magnetic trip unit (TMTU) and a frame inside the molded case circuit breaker.

Other plungers of molded case circuit breakers have an internal spring in which the outer diameter of the spring is the same as the outside envelope of the plunger. The plunger is installed inside the frame of the molded case circuit breaker.

SUMMARY

The inventors have recognized that a technical problem for such autotrip plunger is to have an internal spring that does not affect the mechanical strength of the plunger and that can be easily installed.

At least one embodiment of the present invention is directed to a circuit breaker, in particular a molded case circuit breaker. In particular, at least one embodiment of the present invention provides an autotrip plunger for a circuit breaker, in particular for a molded case circuit breaker, and a circuit breaker, in particular a molded case circuit breaker, which allow assembling an autotrip plunger spring in an easy way and without affecting the mechanical power of the autotrip plunger.

An autotrip plunger and a circuit breaker are disclosed. Further features and details of the present invention result from the sub claims, the description and the drawings. Features and details discussed with respect to the autotrip plunger can also be applied to the circuit breaker and vice versa.

According to a first aspect of an embodiment of the invention, an autotrip plunger of a circuit breaker for opening contacts of the circuit breaker to install and uninstall the circuit breaker from a current source, includes a compression spring. The autotrip plunger comprises a first body section and a second body section, the first body section having a contact surface for contacting a tripping element of the circuit breaker, the second body section comprising an arbor shaft for fitting in the compression spring. At the free end of the arbor shaft the arbor shaft comprises at least one radial protrusion for holding the compression spring.

According to a second aspect of an embodiment of the invention the object is solved by a circuit breaker, in particular a molded case circuit breaker, comprising a fixed contact and a moveable contact, a tripping element for disconnecting the moveable contact from the fixed contact and a moveable autotrip plunger for operating the tripping element to open the contacts of the circuit breaker to install and uninstall the circuit breaker from a current source. The circuit breaker includes the autotrip plunger being an autotrip plunger according to the first embodiment of the invention.

BRIEF DESCRIPTION OF THE DRAWINGS

The present invention is further described with respect to the accompanying figures. It is shown schematically in.

Features with the same function and effect have the same reference numbers in the FIGS. 1 to 7.

DETAILED DESCRIPTION OF THE EXAMPLE EMBODIMENTS

Figure 1:
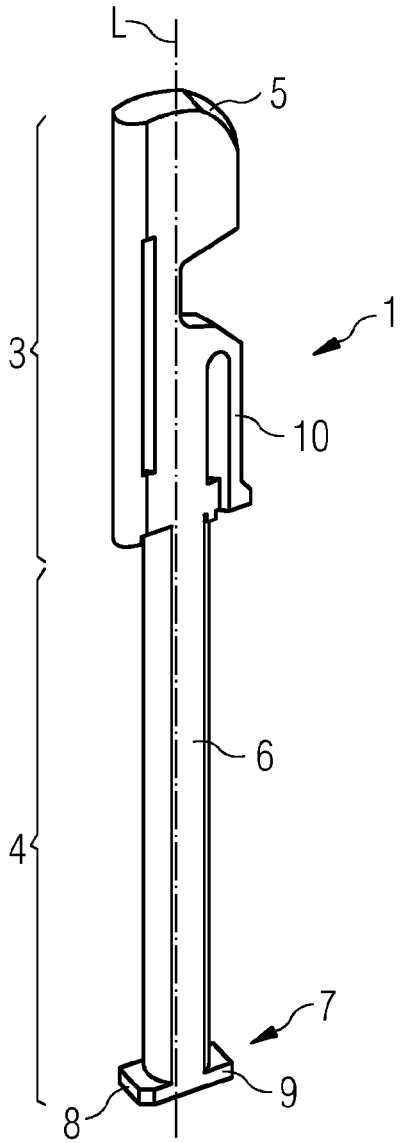
FIG. 1 an autotrip plunger according to an embodiment of the invention.
Figure 2:
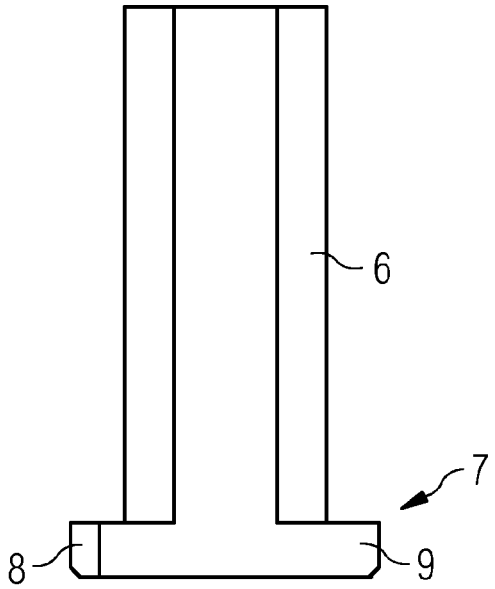
FIG. 2 the bottom part of the autotrip plunger shown in FIG. 1.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

At least one embodiment of the present invention is directed to a circuit breaker, in particular a molded case circuit breaker. In particular, at least one embodiment of the present invention provides an autotrip plunger for a circuit breaker, in particular for a molded case circuit breaker, and a circuit breaker, in particular a molded case circuit breaker, which allow assembling an autotrip plunger spring in an easy way and without affecting the mechanical power of the autotrip plunger.

An autotrip plunger and a circuit breaker are disclosed. Further features and details of the present invention result from the sub claims, the description and the drawings. Features and details discussed with respect to the autotrip plunger can also be applied to the circuit breaker and vice versa.

According to a first aspect of an embodiment of the invention, an autotrip plunger of a circuit breaker for opening contacts of the circuit breaker to install and uninstall the circuit breaker from a current source, includes a compression spring. The autotrip plunger comprises a first body section and a second body section, the first body section having a contact surface for contacting a tripping element of the circuit breaker, the second body section comprising an arbor shaft for fitting in the compression spring. At the free end of the arbor shaft the arbor shaft comprises at least one radial protrusion for holding the compression spring.

Such an autotrip plunger allows assembling the compression spring, which is the autotrip plunger spring, in an easy way and without compromising the mechanical strength of the autotrip plunger. The autotrip plunger comprises a first body section and a second body section. The first and the second body section merge into one another. Advantageously the autotrip plunger is formed as one piece, in particular it is monolithic. Preferably, the body sections of the autotrip plunger are arranged next to each other along the same longitudinal axis.

Since the second body section comprises an arbor shaft for fitting in the compression spring and at the free end of the arbor shaft at least one radial protrusion for holding the compression spring, the compression spring can be placed outside the housing of the circuit breaker. The compression spring can easily be mounted onto the arbor shaft by turning on the compression spring over the at least one radial protrusion to the arbor shaft. After turning on the compression spring on the arbor shaft the at least one radial protrusion at the free end of the arbor shaft serves as a stop for the compression spring in one direction. That means the compression spring is being held on the arbor shaft by at least one radial protrusion at the free end of the arbor shaft. As the compression spring is arranged, in particular form-fitting arranged, around the arbor shaft of the second body section, the second end of the compression spring can be stopped by the frame of the circuit breaker. That means the exterior of the housing can stop the compression spring.

Such an autotrip plunger can be easily installed to the circuit breaker. That means the autotrip plunger can be moved within the circuit breaker, in particular in axial direction, for operating the tripping element inside the circuit breaker. Only the first body section with the contact surface and partly the second body section extend into the inside of the circuit breaker. The compression spring is arranged outside the housing of the circuit breaker. That means the compression spring can be compressed and decompressed outside the circuit breakers frame.

Because of the outside placement of the compression spring, the compression spring can be mounted and dismounted easily form the arbor shaft of the second body section of the autotrip plunger. This outside placement does not occupy internal space of the MCCB.

The at least one radial protrusion has such a dimension that the compression spring is stopped by the at least one radial protrusion after the compression spring is assembled over the protrusion to the arbor shaft.

Preferred is an autotrip plunger with two radial protrusions which are arranged at the free end of the arbor shaft, wherein the two protrusions are arranged at opposite sides or nearly opposite sides of the arbor shaft. Such radial protrusions at the free end of the arbor shaft enable an easy assembling of the compression spring over the radial protrusions to the arbor shaft and further serve as a secure stop for the compression spring after the compression spring is fully turned on to the arbor shaft.

An autotrip plunger is preferred which includes at least one radial protrusion having such a dimension that the compression spring can be assembled over the at least one radial protrusion to the arbor shaft of the second body section of the autotrip plunger. The radial protrusion fits between the pitch of the compression spring, so that the compression spring can be turned to the arbor shaft. To assemble the compression spring to the arbor shaft the compression spring has to be tipped first to the longitudinal axis of the arbor shaft.

The radial protrusion can have any shape. Preferred is an autotrip plunger wherein the at least one radial protrusion is angled 80° to 100° degrees, in particular 90° degrees, to the longitudinal axis of the arbor shaft. Such an arrangement of the at least one protrusion ensures a secure stop for the compression spring after the compression spring is mounted on the arbor shaft. Preferred is an autotrip plunger, by which the at least one radial protrusion is angled 90° degrees. Such an autotrip plunger enables both an easy mounting and an easy dismounting of the compression spring to the arbor shaft of the autotrip plunger.

An autotrip plunger can have an arbor shaft with a rectangular, an elliptical or circular cross-section. Preferred is an arbor shaft with a rectangular cross-section due to space constraints and mechanical requirements. A rectangular profile exhibits best resistance to deflection due to axial loads.

Further, according to a preferred development of an embodiment of the invention an autotrip plunger includes the first body section comprising a latching element, in particular a snap latch, for holding the autotrip plunger inside the circuit breaker. That means the first body section has a latching element, in particular a snap latch, to hold the autotrip plunger inside the frame after a tripping action. The latching element is preferably arranged in the middle of the first body section of the autotrip plunger.

An autotrip plunger can be preferred, wherein the contact surface of the first body section has a cam profile. Such an autotrip plunger enables a secure operation of the tripping element of the circuit breaker. The cam profile ensures a defined actuation of the tripping element, like a tripping lever.

According to a second aspect of an embodiment of the invention the object is solved by a circuit breaker, in particular a molded case circuit breaker, comprising a fixed contact and a moveable contact, a tripping element for disconnecting the moveable contact from the fixed contact and a moveable autotrip plunger for operating the tripping element to open the contacts of the circuit breaker to install and uninstall the circuit breaker from a current source. The circuit breaker includes the autotrip plunger being an autotrip plunger according to the first embodiment of the invention.

Such a circuit breaker, in particular molded case circuit breaker, does not need much space for the autotrip plunger and allows the autotrip plunger spring to be assembled in an easy way and without compromising the mechanical strength of the autotrip plunger. Such a circuit breaker with an autotrip plunger according to the first embodiment of the invention has the same advantages as described already to the autotrip plunger.

The circuit breaker enables to install the autotrip plunger to the circuit breaker in an easy way. The compression spring can be arranged around the second body section of the autotrip plunger, minimizing the envelope occupied by the autotrip plunger and spring combination.

Preferred is a circuit breaker wherein the autotrip plunger is arranged in such a way at the circuit breaker that the first body section is arranged inside the housing of the circuit breaker for contacting with its contact surface the tripping element of the circuit breaker and at least a part of the second body section is arranged outside the housing of the circuit breaker that the compression spring is compressable located outside the housing of the circuit breaker. Such a circuit breaker enables to mount and dismount the compression spring to the arbor shaft of the autotrip plunger. The autotrip plunger compromises the internal free space of the circuit breaker only by a minimum. The compressing spring of the autotrip plunger does not compromise the mechanical strength of the plunger.

The compression spring of the autotrip plunger is preferably arranged between the outside of the housing and the at least one radial protrusion of the arbor shaft of the autotrip plunger. In particular, a circuit breaker is preferred, whereby the compression spring is arranged between the outside of the housing and two radial protrusions at the end of the arbor shaft of the autotrip plunger, whereby the radial protrusions are arranged at opposite sides at the arbor shaft. The autotrip plunger can be moved axial to its longitudinal axis to get in operational contact with the tripping element of the circuit breaker to disconnect the fixed and the moveable contact of the circuit breaker from another. This enables the circuit breaker to be installed and uninstalled to or from a current source.

Further, a circuit breaker is preferred wherein the housing of the circuit breaker comprising a notch for guiding the second body section of the autotrip plunger and for building a stop for the compression spring. The lower housing of the circuit breaker can have a notch to compress the installed compression spring.

FIG. 1 shows an autotrip plunger 1 according to an embodiment of the invention. The autotrip plunger 1 serves for opening contacts of a circuit breaker 20 to install and uninstall the circuit breaker 20 from a current source. The autotrip plunger 1 comprises a first body section 3 and a second body section 4. The first body section 3 is having a contact surface 5 with a cam profile for contacting a tripping element of a circuit breaker 20. The second body section 4 comprises an arbor shaft 6 for fitting in a compression spring 2, whereby at the free end 7 of the arbor shaft 6 the arbor shaft 6 comprises two radial protrusions 8, 9 for holding the compression spring 2 after being assembled to the arbor shaft 6. The two radial protrusions 8, 9 are arranged at the free end 7 of the arbor shaft 6. The two radial protrusions 8, 9 are arranged at opposite sides at the arbor shaft 6.

Figure 3:
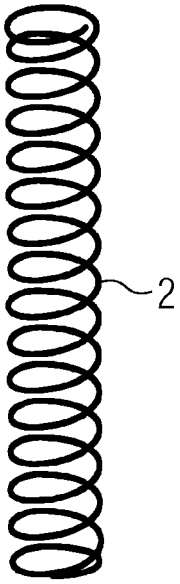
FIG. 3 a compression spring of an autotrip plunger shown in FIG. 1.
Figure 4:
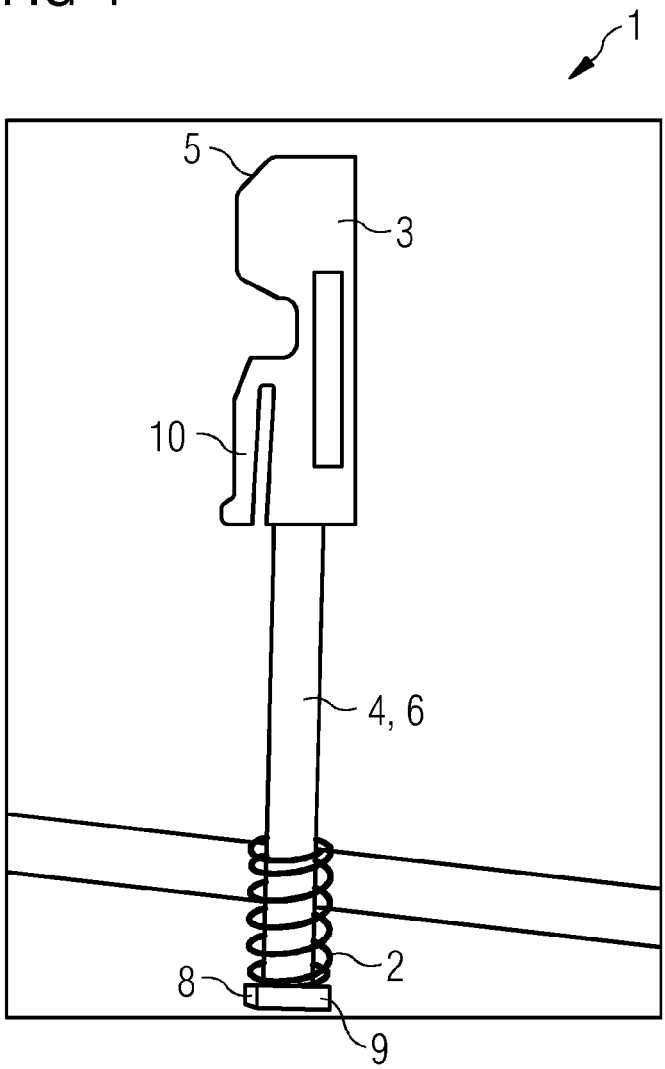
FIG. 4 an autotrip plunger and a compression spring.

A compression spring 2 of an autotrip plunger 1 is shown in FIG. 3. FIG. 4 shows schematically an autotrip plunger 1 and a compression spring 2. The compression spring 2 is assembled around the arbor shaft 6 of the autotrip plunger 1.

Figure 5:
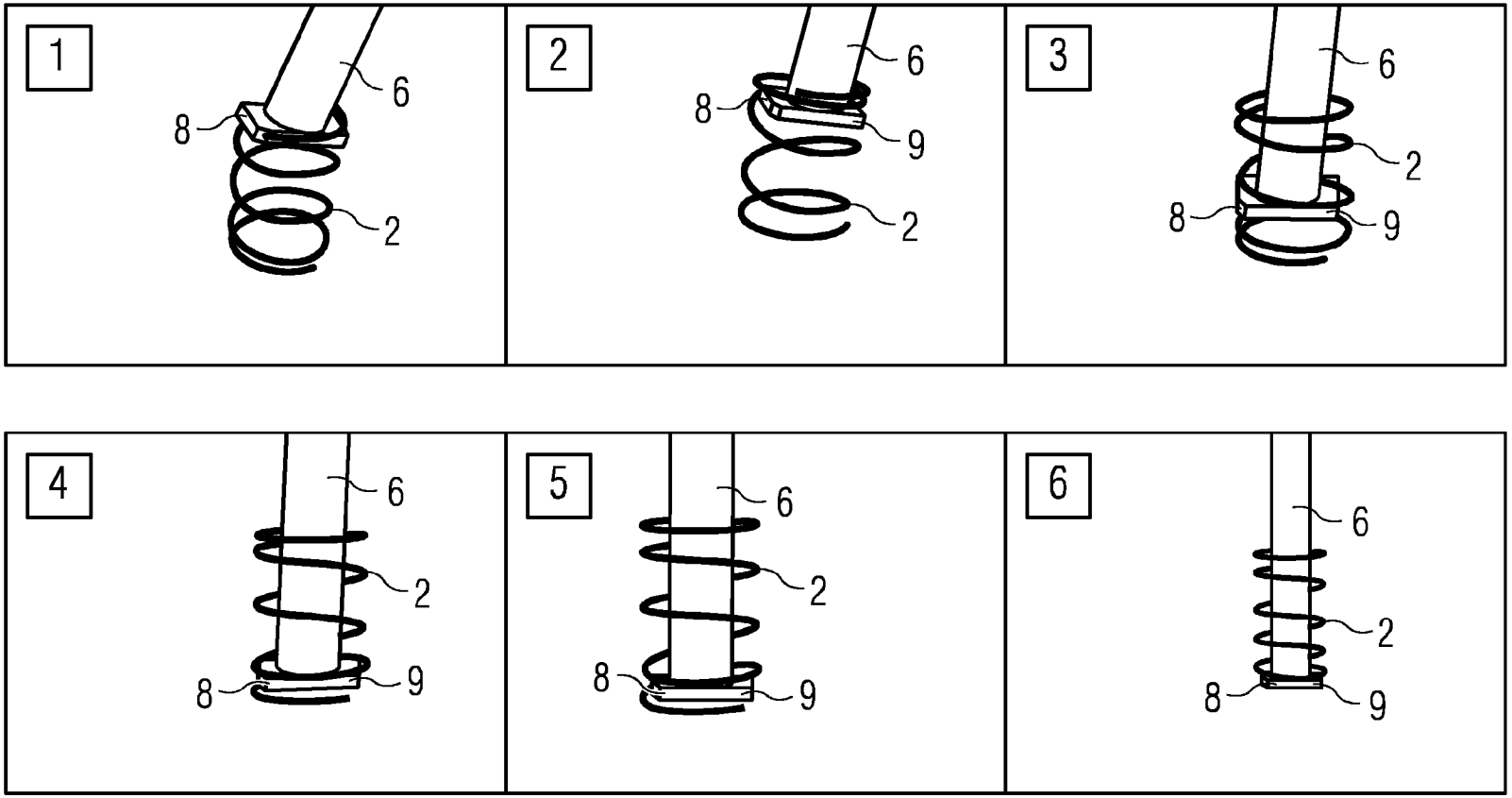
FIG. 5 a mounting sequence of a compression spring to the arbor shaft of an autotrip plunger, FIG. 6 an autotrip plunger installed in a circuit breaker according to an embodiment of the invention, and FIG. 7 a view from beneath to a circuit breaker according to an embodiment of the invention.

A mounting sequence of a compression spring 2 to the arbor shaft 6 of an autotrip plunger 1 is shown in FIG. 5. First the compression spring 2 has to be tilted to the longitudinal axis of the arbor shaft 6. Thereby at first protrusion 9 is arranged between the winding of the compression spring 2, see FIG. 5(1). Than the compression spring 2 is turned, so that the second protrusion 8 is arranged between the winding of the compression spring 2 as well, see FIG. 5(2). Afterwards that the compression spring 2 is further being turned till the protrusions 8, 9 reach end of the compression spring 2, see FIG. 5(3). In FIG. 5(4) the first protrusion 9 has reached the end of the compression spring 2. In FIG. 5(5) the second protrusion 8 has reached the end of the compression spring 2 as well. In FIG. 5(6) the compression spring 2 is fully assembled to the arbor shaft 6 of the autotrip plunger 1. The protrusions 8, 9 serves as stop now for the compression spring 2.

Figure 6:
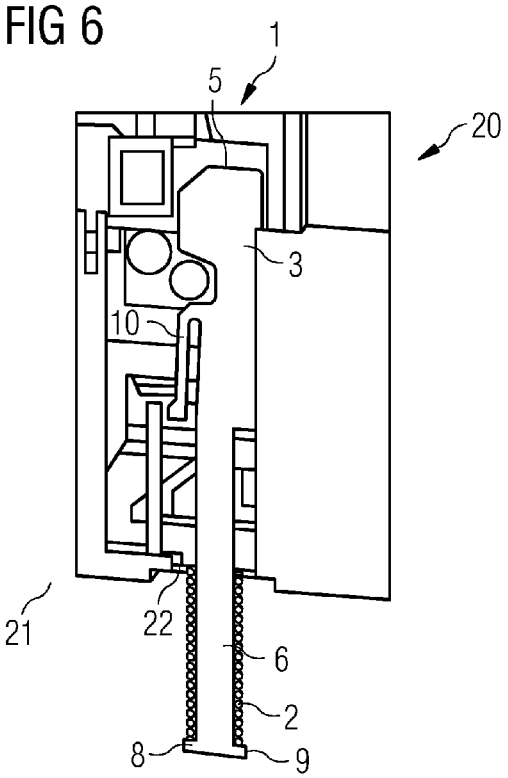

After being assembled to the arbor shaft 6 of the autotrip plunger 1 the compression spring 2 can be compressed in the installed position at a circuit breaker 20. Such situation is shown in FIG. 6. The autotrip plunger 1 is installed in a circuit breaker 20. The compression spring 2 fits between the protrusions 8, 9 and the notch 22 at the upper housing 21 of the circuit breaker 20. When the autotrip plunger 1 is moved into the circuit breaker 20, the compression spring 2 is compressed. The force of the compression spring 2 enables that the autotrip plunger 1 can get back in its normal position, in which the compression spring 2 is decompressed or nearly decompressed.

Figure 7:
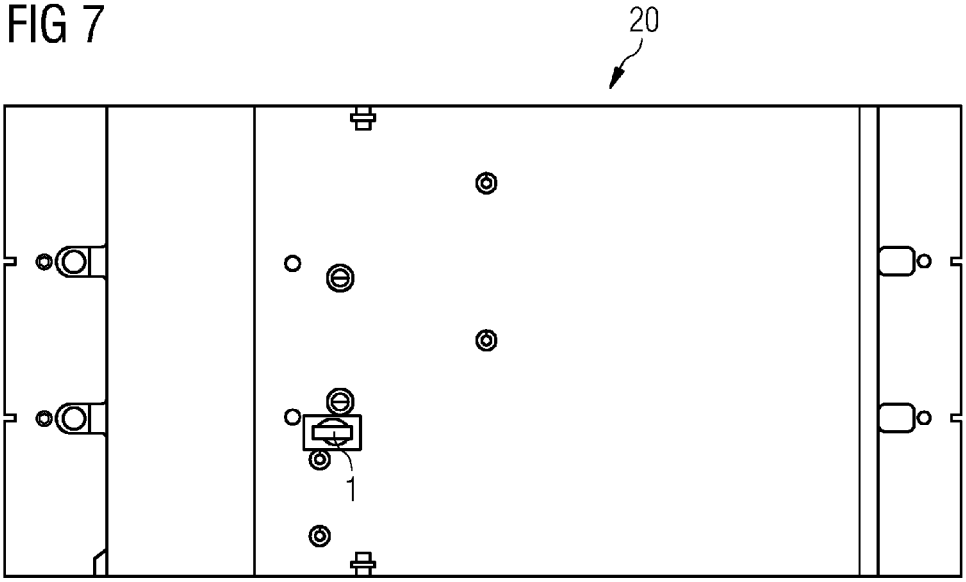

FIG. 7 shows a view from beneath to a circuit breaker 20 according to an embodiment of the invention.

The technical problem of an autotrip plunger, namely to have a spring 2 that does not compromise the mechanical strength of the plunger is solved by an autotrip plunger 1 shown in FIGS. 1 to 7. The compression spring 2 of the autotrip plunger 1 is placed outside the circuit breaker 20, in particular the molded case circuit breaker, and therefore can be easily installed. This way, the compression spring 2 can be around the plunger's body, reducing its envelope and minimizing its spacing to live parts of the circuit breaker 20.

The autotrip plunger has two body sections 3, 4. The first body section 3 comprises a cam profile to trip the tripping mechanism of the circuit breaker 20 and the snap latch 10 to be inside the frame after the tripping action. The second body section 4 comprises an arbor shaft 6 for the compression spring 2. The arbor shaft 6 has preferably a cross section which fits into the windings of the compression spring 2. The arbor shaft 6 has preferably a height set to the pitch of the compression spring 2. This allows momentary deflection of the compression spring 2 for introduction and installment.

Using this principle the compression spring 2 can be twisted into the autotrip plunger 1 without having a slot that compromises the mechanical strength of the autotrip plunger 1 and with the compression spring's outer diameter contained into the autotrip plunger's body. The lower housing 21 of the circuit breaker 20 has a notch 22 to compress the installed compression spring 2. The compression spring 2 can be placed outside the circuit breakers frame. The autotrip plunger has an arbor shaft 6 that can contain the outer diameter of the compression spring 2 within its widest cross section saving distance from live parts inside the circuit breaker 20. The arbor shaft 6 can avoid a slot that compromises the mechanical strength of the plunger 1. The height of the arbor shaft 6 is set at least as the pitch of the spring. That allows the momentary deflection of the compression spring 2 for installment. The protrusions allow the twisting of the compression spring 2 until it is fully installed in the arbor shaft 6. The notch 22 in the lower housing 21 of the circuit breaker 20 allows the compression of the compression spring 2 without compromising the internal space of the circuit breaker 20. The second body profile 4 can be a round beam. But due to space constraints and mechanical requirements, a rectangular profile of the second body profile 4 exhibits best resistance to deflection due to axial loads.

Reference Signs

1 autotrip plunger
2 compression spring
3 first body section
4 second body section
5 contact surface
6 arbor shaft
7 free end
8 radial protrusion
9 radial protrusion
10 latching element
20 circuit breaker
21 housing
22 notch
L longitudinal axis

What is claimed is:

1. Autotrip plunger of a circuit breaker for opening contacts of the circuit breaker to at least one of install and uninstall the circuit breaker from a current source, comprising:

a compression spring;

a first body section including a contact surface configured to contact a tripping element of the circuit breaker; and a second body section including an arbor shaft configured to fit in the compression spring, wherein, at a free end of the arbor shaft, the arbor shaft includes at least one radial protrusion configured to hold the compression spring, wherein two radial protrusions are arranged at the free end of the arbor shaft, and wherein the two protrusions are arranged at opposite sides or nearly opposite sides of the arbor shaft.

2. Autotrip plunger of claim 1, wherein the arbor shaft includes at least one of a rectangular, an elliptical or circular cross-section.

3. Autotrip plunger of claim 1, wherein the contact surface of the first body section includes a cam profile.

4. Autotrip plunger of claim 1, wherein the at least one radial protrusion is of such a dimension that the compression spring is assembleable over the at least one radial protrusion to the arbor shaft of the second body section of the autotrip plunger.

5. Circuit breaker, comprising: the autotrip plunger of claim 3.

6. Autotrip plunger of claim 1, wherein the at least one radial protrusion is angled 80° to 100° degrees to the longitudinal axis of the arbor shaft.

7. Autotrip plunger of claim 6, wherein the at least one radial protrusion is angled 90° degrees to the longitudinal axis of the arbor shaft.

8. Autotrip plunger of claim 1, wherein the first body section comprises a latching element configured to hold the autotrip plunger inside the circuit breaker.

9. Autotrip plunger of claim 8, wherein the latching element is a snap latch.

10. Circuit breaker, comprising: the autotrip plunger of claim 1.

11. Circuit breaker of claim 10, wherein the compression spring of the autotrip plunger is arranged between an outside of a housing of the circuit breaker and the at least one radial protrusion of the arbor shaft of the autotrip plunger.

12. Circuit breaker of claim 10, wherein the circuit breaker is a molded case circuit breaker.

13. Circuit breaker, comprising:

a moveable autotrip plunger configured to open contacts of the circuit breaker to at least one of install and uninstall the circuit breaker from a current source, wherein the movable autotrip plunger includes a compression spring, a first body section including a contact surface configured to contact a tripping element of the circuit breaker, and a second body section including an arbor shaft configured to fit in the compression spring, wherein, at a free end of the arbor shaft, the arbor shaft includes at least one radial protrusion configured to hold the compression spring, and wherein the movable autotrip plunger is arranged in such a way at the circuit breaker that the first body section is arranged inside a housing of the circuit breaker for contacting with its contact surface the tripping element of the circuit breaker and at least a part of the second body section is arranged outside the housing of the circuit breaker such that the compression spring is located outside the housing of the circuit breaker.

14. Autotrip plunger of claim 13, wherein the at least one radial protrusion is of such a dimension that the compression spring is assembleable over the at least one radial protrusion to the arbor shaft of the second body section of the autotrip plunger.

15. Circuit breaker of claim 13, wherein the housing of the circuit breaker comprises a notch, configured to guide the second body section of the autotrip plunger and configured to build a stop for the compression spring.

16. Circuit breaker of claim 13, wherein the compression spring of the autotrip plunger is arranged between the outside of the housing and the at least one radial protrusion of the arbor shaft of the autotrip plunger.

17. Circuit breaker of claim 16, wherein the housing of the circuit breaker comprises a notch, configured to guide the second body section of the autotrip plunger and configured to build a stop for the compression spring.

18. Circuit breaker, comprising:

a moveable autotrip plunger configured to open contacts of the circuit breaker to at least one of install and uninstall the circuit breaker from a current source, wherein the movable autotrip plunger includes a compression spring, a first body section including a contact surface configured to contact the tripping element of the circuit breaker, and a second body section including an arbor shaft configured to fit in the compression spring, wherein, at a free end of the arbor shaft, the arbor shaft includes at least one radial protrusion configured to hold the compression spring, wherein the compression spring of the autotrip plunger is arranged between the outside of a housing and the at least one radial protrusion of the arbor shaft of the autotrip plunger and wherein a housing of the circuit breaker comprises a notch, configured to guide the second body section of the autotrip plunger and configured to build a stop for the compression spring.

19. Circuit breaker, comprising:

a moveable autotrip plunger configured to open contacts of the circuit breaker to at least one of install and uninstall the circuit breaker from a current source, wherein the movable autotrip plunger includes a compression spring, a first body section including a contact surface configured to contact the tripping element of the circuit breaker, and a second body section including an arbor shaft configured to fit in the compression spring, wherein, at a free end of the arbor shaft, the arbor shaft includes at least one radial protrusion configured to hold the compression spring, and wherein a housing of the circuit breaker comprises a notch, configured to guide the second body section of the autotrip plunger and configured to build a stop for the compression spring.

* * * * *